US006267321B1

(12) United States Patent
Tramontina

(10) Patent No.: US 6,267,321 B1
(45) Date of Patent: Jul. 31, 2001

(54) DISPENSING APPARATUS AND METHOD

(75) Inventor: Paul Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/603,975

(22) Filed: Jun. 27, 2000

(51) Int. Cl.[7] ..... B65H 18/02

(52) U.S. Cl. ..... 242/593; 242/615.3; 242/615.4; 242/132; 242/137; 206/409; 220/253

(58) Field of Search ..... 242/593, 132, 242/137, 146, 615.3, 615.4; 206/409, 390, 394, 205, 210, 812; 220/253; 221/63

(56) References Cited

U.S. PATENT DOCUMENTS 995,203 * 6/1911 Thomas et al. ..... 220/253
4,524,895 * 6/1985 Lunden .
4,526,291 * 7/1985 Margulies ..... 206/409
4,760,970 * 8/1988 Larsson et al. ..... 242/593
5,269,432 * 12/1993 Beckertgis ..... 220/253
5,370,338 12/1994 Lewis .
5,577,634 * 11/1996 Morand ..... 221/63 X

* cited by examiner

*Primary Examiner*—William A. Rivera
(74) *Attorney, Agent, or Firm*—Dority & Manning, PA

(57) ABSTRACT

A centerflow rolled paper dispenser is provided in which the dispenser comprises a housing containing a spring loaded drawer member that is slidable between an open and a closed position. The dispenser includes an upper housing and a support member within said upper housing for supporting a roll of paper. Further, a lower housing is attached to the upper housing. An exit port from said upper housing to said lower housing is provided for release of rolled paper that is dispensed from the center of the roll through a predetermined dispensing orifice. Additionally, the drawer member is in substantially overlapping position with the exit port, the drawer member being spring loaded to bias the drawer member towards the open position to make loading a new roll of paper into the dispenser more convenient. A rotatable disk is provided with orifices of varying size disposed on the periphery thereof.

21 Claims, 6 Drawing Sheets

DISPENSING APPARATUS AND METHOD

BACKGROUND OF THE INVENTION

Paper dispensing devices that dispense paper from the center of a paper roll are known as centerflow dispensers. The web of paper in such dispensers is fed from the axial portion or center of the paper roll.

Dispensers preferably must be easy to use and operate Maintenance personnel using dispensers may not be trained adequately in the operation of the dispenser which they are hired to refill. Therefore, if is imperative to provide a dispenser that is easy to understand and relatively simply to reload with a new paper roll.

Prior art centerflow feed dispensers such as the dispenser shown in U.S. Pat. No. 5,370,338 provide a variable orifice that may be dialed or adjusted to meet the needs of the paper roll being dispensed. Different size rolls require a different dial setting. The frictional engagement of the paper with the orifice provides an appropriate amount of friction to tear the paper at the perforations, but only at the perforations. In such dispensers, the diameter of the dispensing orifice may be varied to accommodate different rolled products.

Unfortunately, many prior art centerflow dispensers are difficult and time consuming to load with a new paper roll. Many existing dispensers require several or multiple steps in loading a new roll. Dispensers that include a two piece housing often first must be disassembled, or hinged away. Then, a sliding mechanism must be manually disengaged, and moved from one position to another in order to fully engage the paper stream that emerges from the bottom of a center feed roll. Sometimes, operators do not understand the sliding mechanisms of such dispensers, and may incorrectly or inadequately displace such slides. Also, many prior dispensers undesirably pinch paper when sliding mechanisms are activated, causing rolls to misfeed when the dispenser housing is closed and the dispenser is placed in operation.

What is needed is a centerflow dispenser that is capable of being loaded with new paper rolls easily and conveniently. Further, a dispenser that is capable of configuring itself for loading of a new roll automatically, without additional steps, upon opening of the housing, would be highly desirable. Additionally, a dispenser that reduces the number of steps required to insert a new roll would be useful. A dispenser that uses a variable orifice, but does not undesirably pinch the paper when a new roll is inserted would also be desirable.

SUMMARY OF THE INVENTION

It is therefore an object of the present invention to provide a dipsenser for rolled paper webs wherein the diameter of the dispensing orifice is variable to accommodate different rolled paper products.

It is a further object of the present invention to provide a centerflow dispenser that is adaptable for use with rolled paper webs of different bulks, as well as different weights, widths and tensile strengths.

It is a further object of the present invention to make reloading the dispenser with new rolls of paper easier and more convenient. Less steps are required to reload the dispensers of this invention as compared to other prior art dispensers.

One object of this invention is to provide a mechanism that automatically presents itself in a configuration for fast and efficient reloading when the housing is opened, facilitating relatively easy and convenient threading of a new roll into a dispensing position.

Another object of the present invention is to provide a centerflow dispenser that incorporates a large exit port through which the rolled paper product can be initially inserted.

In one embodiment of the invention, a centerflow paper roll dispenser is provided comprising an upper housing and a support member within said upper housing for supporting a roll of paper. The lower housing is attached to the upper housing. Further, an exit port is provided from the upper housing to the lower housing. A spring loaded means within the lower housing positions any one of a plurality of user interchangeable dispensing orifices of differing diameters such that the roll can be dispensed from the center of the roll through a predetermined dispensing orifice. The spring loaded means further comprises a drawer member slidably engageable with the lower housing and configured to slide between an open and a closed position, the drawer member supporting one of the orifices in substantially overlapping position with said exit port. Further, the drawer member is spring loaded to bias the drawer member towards the open position.

In another embodiment, a dispenser is provided wherein a drawer member is capable of sliding between open and closed positions in response to the position of the upper housing. Other configurations provide for a dispenser in which the upper housing is capable of assuming an open position for loading a new paper roll into the dispenser, and a closed position for dispensing paper from a paper roll. In this embodiment, the drawer member is held open by spring action when the upper housing is in the open position and the drawer member is held closed when the housing is in the closed position.

In one aspect of the invention, a dispenser also comprises a means for positioning a disk with said plurality of orifices disposed in the periphery thereof, said disk being rotatably supported on said drawer member. A dispenser also is disclosed in which the spring loaded means is actuated by a coil spring.

In a further aspect of the invention, a dispenser is shown in which the upper housing comprises an inner surface and an outer surface, the inner surface of the housing being capable of engaging and closing the drawer member when the housing is articulated from the open to the closed position. In one embodiment, the dispenser is shown with an exit port extending from said upper housing to said lower housing through which the roll of paper is dispensed from the center of the roll.

In one embodiment, a dispenser is provided in which a drawer member provides a means to minimize pinching of paper when the paper is dispensed through the exit port. In one embodiment, the dispenser is provided in which a coiled spring holds the drawer member against the upper housing when the housing is in the closed or dispensing position.

A dispenser also is provided in which the drawer member is movable from an open position partially extending from said lower housing to a closed position substantially within said lower housing, said means for interchanging said dispensing orifices rotatably affixed to said drawer member.

In another aspect of the invention, a centerflow dispenser is provided for dispensing a coreless rolled web comprising a lower housing above which the rolled web is supported, said lower housing forming a first compartment. Further, an upper housing mounted above said lower housing forms a second compartment. The second compartment contains the rolled web. The first compartment has an opening into said second compartment. A disk rotatably resides within said lower housing. The disk comprises a plurality of orifices of differing diameters disposed through the periphery thereof. An exit port is provided through said lower housing, the rolled web being dispensed from the center of the roll, through said opening and through said exit port. Each of said orifices is capable of being positioned to overlap the exit port by rotation of the disk so that the rolled web can be dispensed through a selected one of said orifices. Further, a spring loaded drawer member is provided within said lower housing.

In a further embodiment of the invention, a method of dispensing a rolled web of paper from a coreless centerflow dispenser is provided. In the invention, a lower housing is provided above which a rolled web is supported, said lower housing forming a first compartment, the lower housing comprising a spring loaded drawer member. In another aspect of the invention, an upper housing is mounted above said lower housing, said upper housing forming a second compartment, said second compartment being configured for containing the rolled web, said first compartment having an opening into said second compartment. The method further includes providing a rotatable disk within said lower housing, said disk having a plurality of orifices of differing diameters disposed through the periphery of the disk. An exit port is provided through said lower housing, the rolled web being dispensed from the center of the roll, through said orifice and through said exit port, each of said orifices capable of being positioned to overlap said exit port by rotation of said disk so that the rolled web is be dispensed through a selected one of said orifices. The method further comprises springing open a drawer member when the housing is opened, the drawer member being configured to open automatically when the housing is opened. In the method, one may load a paper web into the housing of the dispenser and then close the housing of the dispenser. Further, an additional step includes dispensing paper from the dispenser.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

Figure 1:
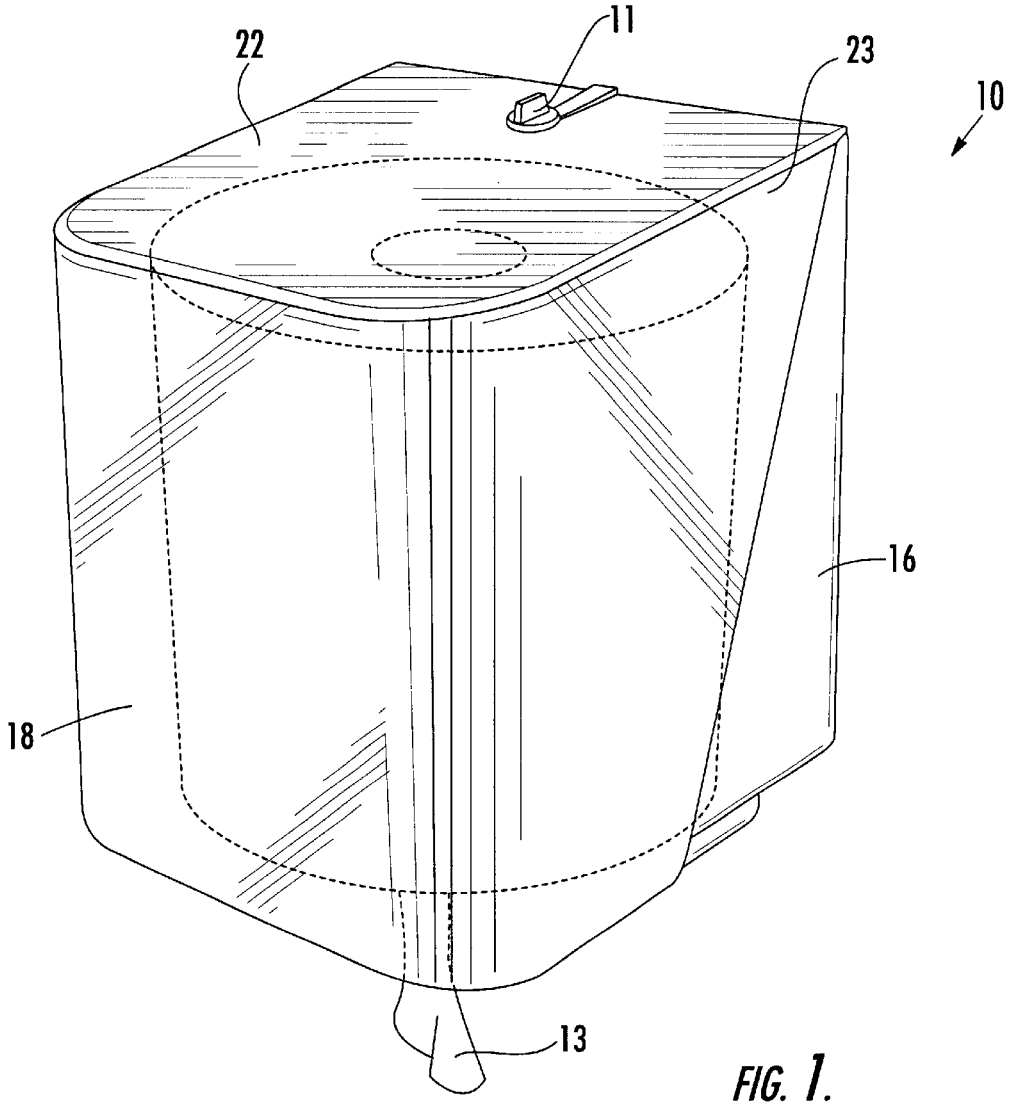
FIG. 1 is an isometric view of the centerflow dispenser of this invention.
Figure 2:
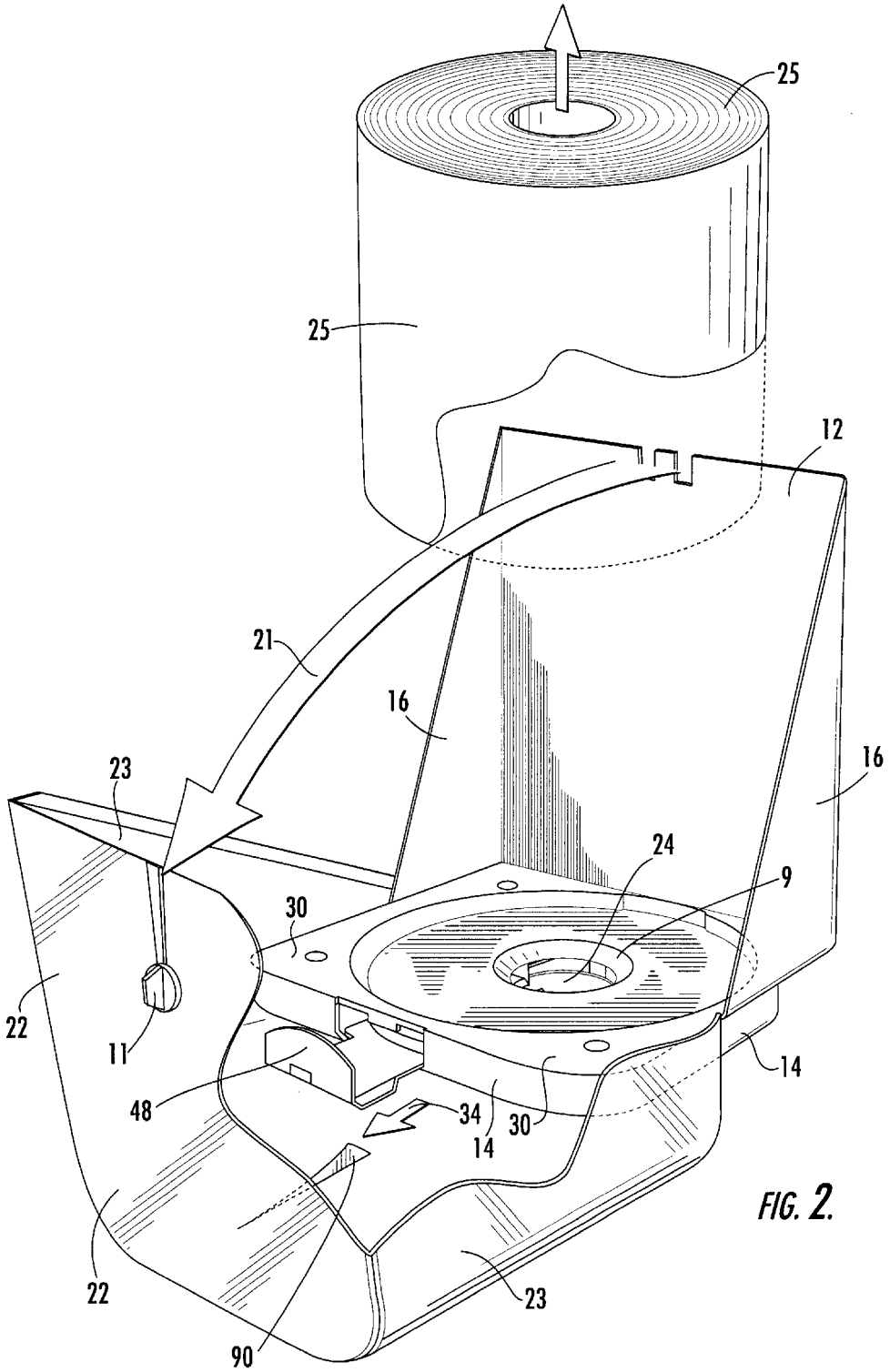
FIG. 2 shows the dispenser opened and ready to receive a new paper roll.

Turning to FIG. 1, a centerflow dispenser 10 is shown comprising an upper housing that includes a top or lid section 22 and a door or front housing 18. The centerflow dispenser includes a wall mounting plate 12 (shown in FIGS. 2 and 3) which has affixed upon it a lower housing or support member, shown in FIGS. 2 and 3. Further, brackets 16 form the sides of the lower housing. Side sections 23 form the side portion of the upper housing. A latch 11 disconnects the upper housing from the lower housing when it is turned, facilitating the movement of the upper housing in a downward position to expose the inner portion of the dispenser, as shown in FIG. 2. Paper 13 is dispensed from the lower portion of the dispenser as shown in FIG. 1.

FIG. 2 shows the paper roll which can be lowered or raised into or out of the dispenser when the dispenser is in the loading position as shown in FIG. 2. The top or lid section 22 of the upper housing is hingedly affixed so that it can tilt forward along the path of direction arrow 21 when paper is to be loaded. The paper roll 25 may rest upon the surface of the lower housing plate 14 as paper 13 is fed through the lower exit port 24 beside tapered edge 9. The spring loaded handle member 48 projects out when the housing is tilted, along the direction of the arrow 34, which opens the exit port fully as further seen in detail in FIG. 4. A cover 30 is provided to encase the top portion of lower housing plate, which holds the spring mechanism which will be discussed below.

Figure 3:
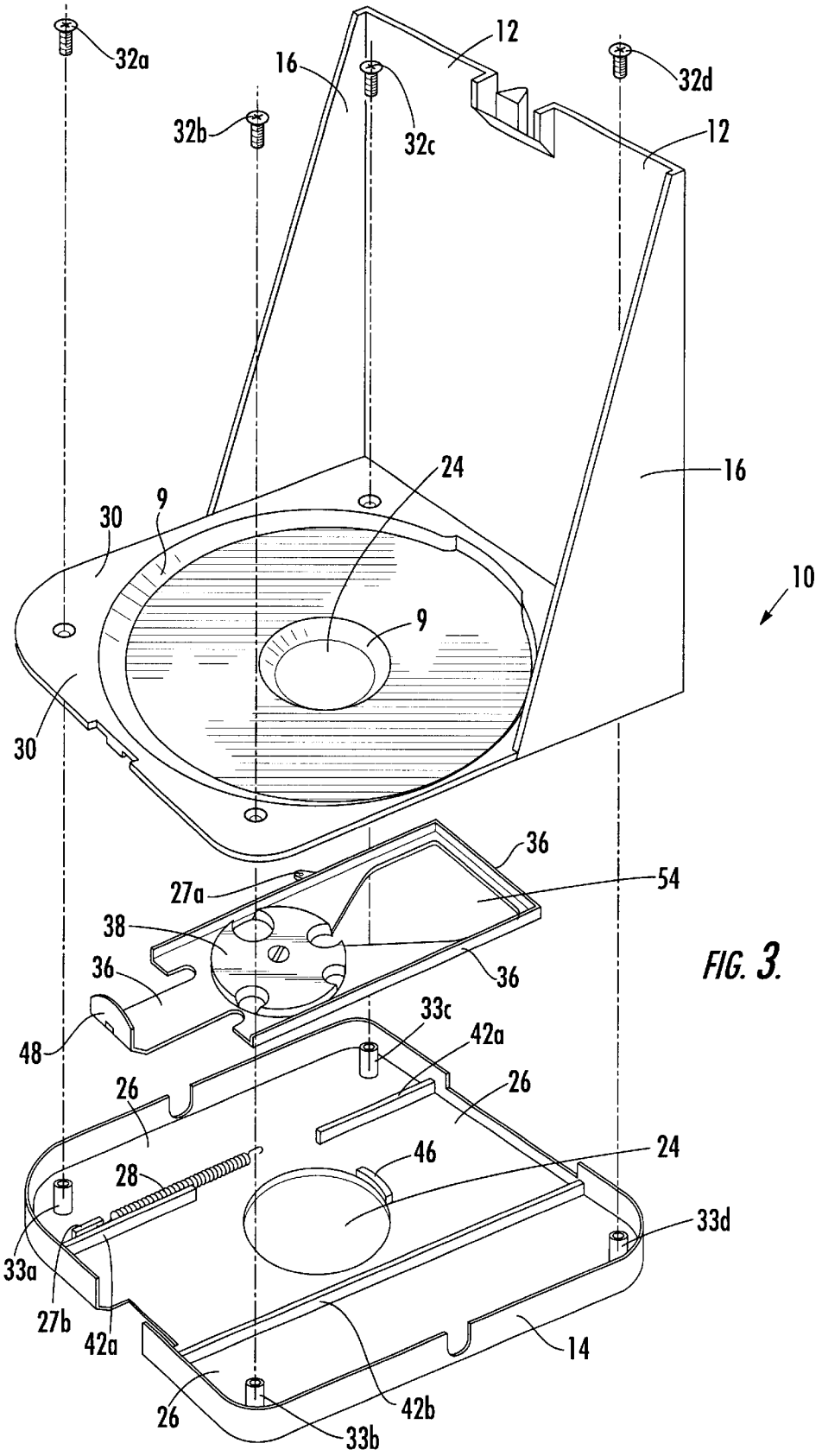
FIG. 3 depicts an exploded view of the lower housing of the dispenser.

In FIG. 3, an exploded view of the dispenser is shown with screws 32*a–d* removed from the housing screw channels 33*a–d* shown in FIG. 3. The housing is separated into three primary portions, with lower housing plate 14 serving to protect drawer 36 in its location between guide members 42*a* and 42*b*. The drawer 36 is provided with a spring retainer 27*a* on its side surface which connects to one end of spring 28, while the spring retainer 27*b* secures the opposite end of spring 38. A disk 38 rotates to expose varying size aperatures into the opening 54.

Figure 4:
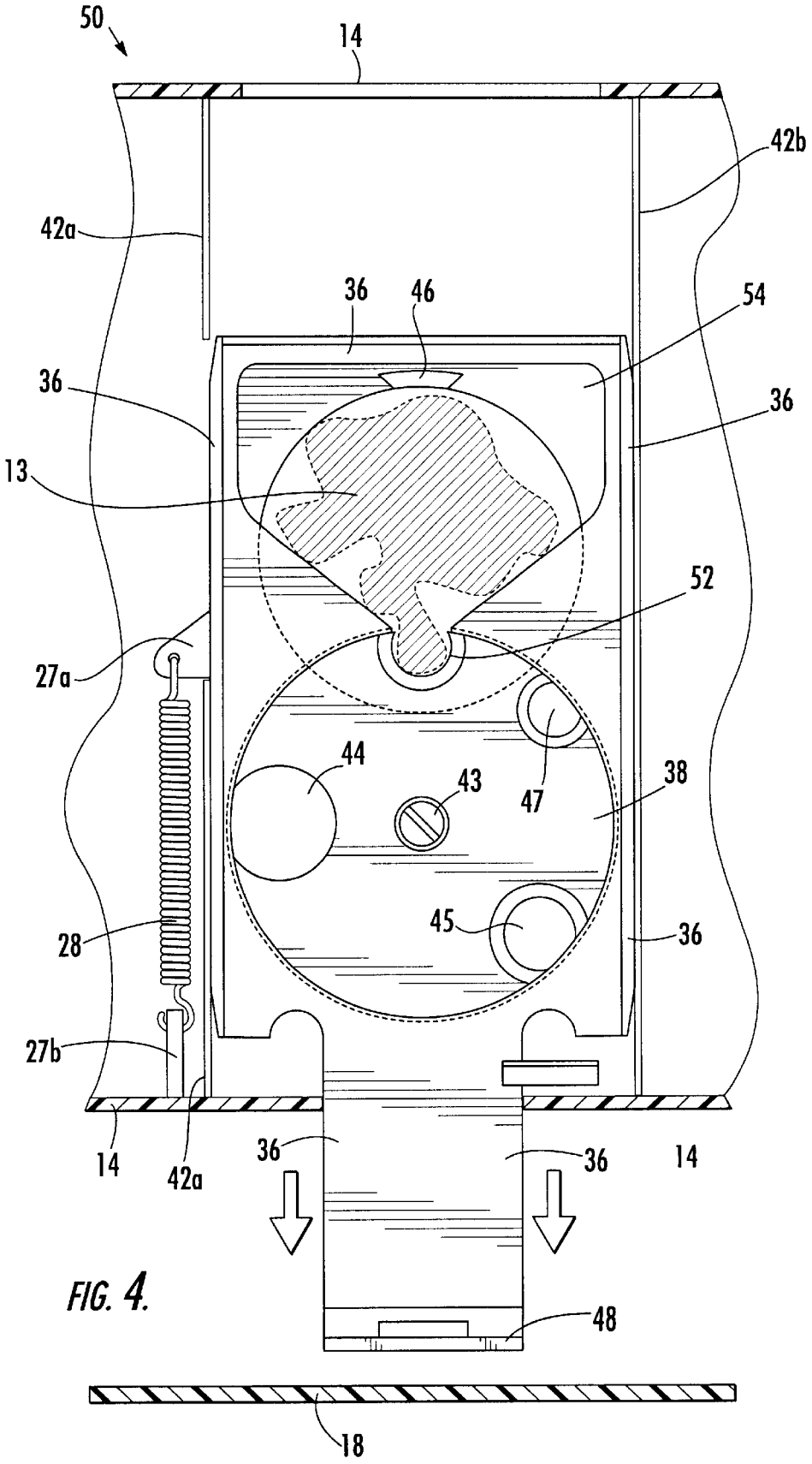
FIG. 4 shows a top view of the slide mechanism in the paper loading mode.

Extending from the disk 38 in drawer 36 is the V-shaped opening such that the point of the "V" (or point of convergence) if projected would converge and terminate within the hole 52 as shown in FIG. 4. Although opening 54 is preferably V-shaped, the shape of opening 54 may be varied so long as the sides of opening 54 remain substantially divergent.

The slide mechanism 50 is shown in FIG. 4. Lower housing plate 14 is shown on the back side of the dispenser with the door or front housing 18 shown in the lower portion of FIG. 4. Handle member 48 is shown pulled out from the drawer 36 by the retraction of spring 28. The spring 28 keeps a constant tension force upon the spring retainer 27*a,* which in turn keeps a constant force upon the drawer member 48, acting to push or bias it out from the lower housing plate 14. FIG. 4 shows the drawer 36 in the loading mode with paper 13 being easily fed down through the opening 54 and past hole 52. When drawer 36 is fully inserted between guide members 42*a–b* (as by contact force caused by the housing being closed or shut) hole 52 overlaps or aligns concentrically with lower exit port 24. The disk 38 may be rotated so that each of the orifices may be rotated into position to vertically overlap or align with hole 52. The large aperture 44, medium aperture 45, small aperture 47 each may be positioned over the hole 52 to enable paper feedthrough.

Figure 5:
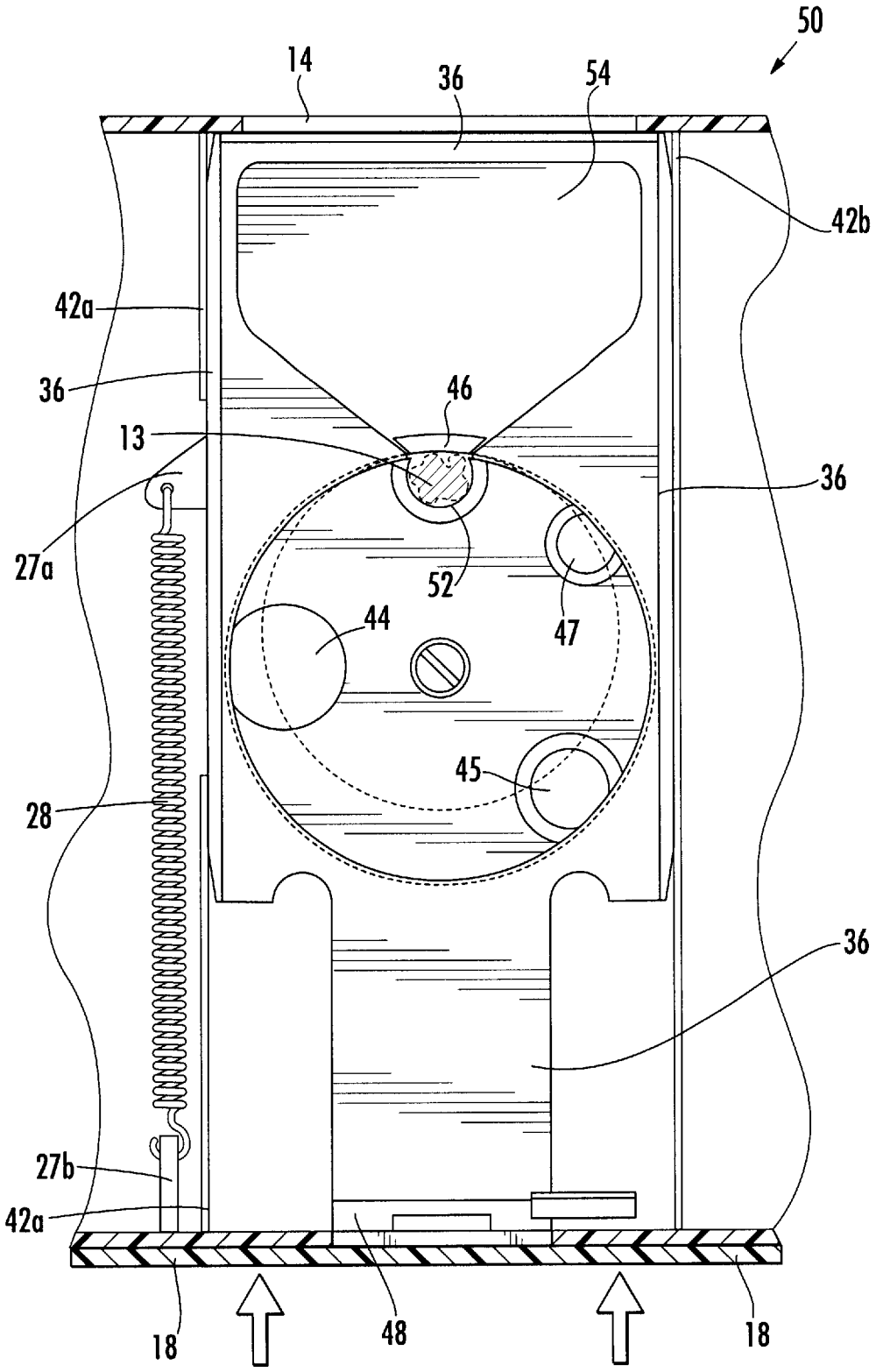
FIG. 5 is a top view of the slide mechanism when the upper housing is closed, and the dispenser is in the dispensing mode.
Figure 6:
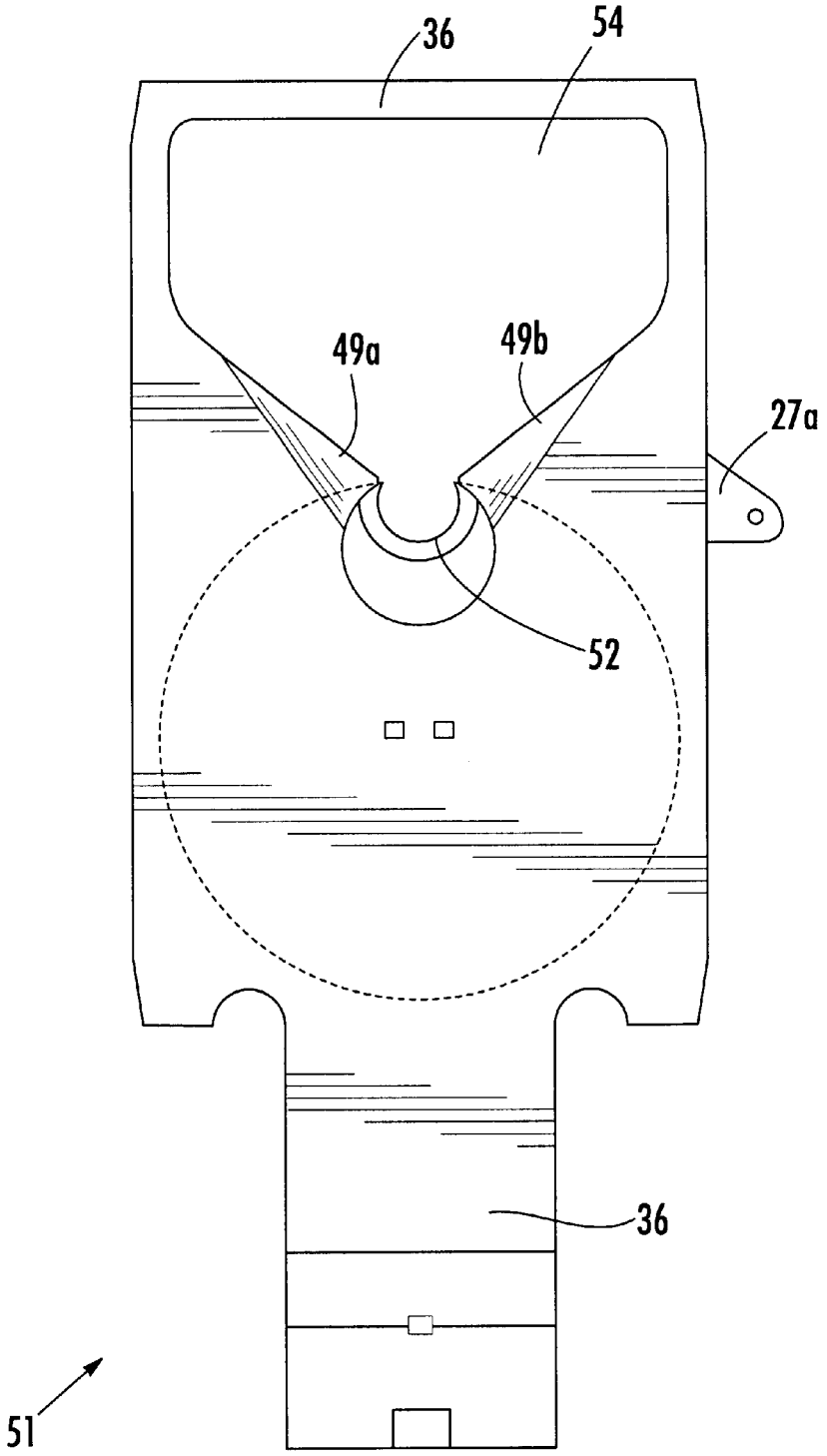
FIG. 6 shows a top view of the slide member.

To load the centerflow dispenser of this invention, the door or front housing 18 is unlatched and pivoted downward thereby exposing a handle member 48 of drawer 36, which is pushed outward as the housing is removed from frictional engagement with the outer surface of the handle member 48. Thus, when the housing is opened, the handle member 48 by spring action automatically opens fully to expose a large V-shaped opening in alignment with lower exit port 24. Thus, a relatively large opening is provided in which the lead end of the rolled paper web 13 can be easily inserted. The paper is inserted, and then the housing may be hinged back upwards. As this occurs, and the housing is hingedly closed, the slide mechanism 50 is pushed back into the lower housing such that the opening for dispensing the paper is decreased as shown in FIG. 5. Hole 52 is now positioned to provide paper 13, while the drawer 36 is pushed fully into the lower housing and against lower housing plate 14. The housing articulates with the front lip of the handle member 48 using a closing rib 90 which is shaped and tapered to achieve an appropriate proper rate of push against the drawer 36 when the upper or front housing is moved from the open to the closed position. Paper is refrained from pinching between the drawer and the lower housing by using tapered edges 49*a–b* as shown in FIG. 6. FIG. 6 shows the slide member 51 from the lower side, with hole 52 and opening 54 visible.

When the dispenser is closed, the closing rib 90 contacts the handle 48 as the door 18 is rotated to a closed position. Closing rib 90 will urge handle 48 and drawer 36 to a closed position.

It should be recognized that the dispensing orifices could be of any of a variety of geometric shapes such as, for example, elliptical or polygonal.

Further, it is recognized that the spring can be a coil spring or another type of spring, such as a leaf spring or other springing mechanism or device. Many embodiments may cause the handle member to be in springing engagement with the housing. Many different embodiments are contemplated and are possible for use in connection with the invention.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A centerflow paper roll dispenser, comprising:

(a) an upper housing;

(b) a support member within said upper housing for supporting a roll of paper;

(c) a lower housing attached to said upper housing;

(d) an exit port from said upper housing to said lower housing; and (e) a spring loaded means within said lower housing for positioning any one of a plurality of user interchangeable dispensing orifices of differing diameters such that the roll can be dispensed from the center of the roll through a predetermined dispensing orifice, the means further comprising a drawer member slidably engageable with said lower housing and configured to slide between an open and a closed position, the drawer member supporting one of said orifices in substantially overlapping position with said exit port, the drawer member being spring loaded to bias the drawer member towards the open position.

2. The dispenser of claim 1 wherein the drawer member slides between the open and closed positions in response to the position of the upper housing.

3. The dispenser of claim 1 in which the upper housing assumes an open position for loading a new paper roll into the dispenser, and a closed position for dispensing paper from a paper roll, the drawer member being held open by spring action when the upper housing is in the open position and the drawer member being held closed when the drawer member is in the closed position.

4. The dispenser of claim 3 in which the drawer member is closed by contact with the upper housing.

5. The dispenser of claim 4 in which the upper housing comprises an inner surface and an outer surface, the inner surface of the housing engages and closes the drawer member when the housing is articulated from the open to the closed position.

6. The dispenser of claim 1 wherein the means for positioning further comprises a disk with said plurality of orifices disposed in the periphery thereof, said disk being rotatably supported on said drawer member.

7. The dispenser of claim 1 in which the spring loaded means is actuated by a coil spring.

8. The dispenser of claim 7 in which the coiled spring is connected to the drawer member.

9. The dispenser of claim 7 in which the coiled spring is connected on one end to the drawer member and on the opposite end to the lower housing.

10. The dispenser of claim 9 in which the coiled spring holds the drawer member against the upper housing when the housing is in the closed or dispensing position.

11. The dispenser of claim 1 in which the roll of paper is dispensed from the center of the roll.

12. The dispenser of claim 11 in which the drawer member provides a means to minimize pinching of the paper when the paper is dispensed through the exit port while the drawer member is slidably operated.

13. The dispenser of claim 12 in which the drawer member comprises an opening for passage of paper during the dispensing of paper, further wherein the means to minimize pinching of paper comprises a tapered edge upon the periphery of the opening in the drawer member.

14. The dispenser of claim 1 in which the drawer member is movable from an open position partially extending from said lower housing to a close position substantially within said lower housing, said means for interchanging said dispensing orifices rotatably affixed to said drawer member.

15. The dispenser of claim 14 wherein said drawer member includes a first opening therein, further wherein said first opening has substantially diverging sides with the point of convergence of said substantially diverging sides residing in a second opening through which the paper is dispensed, said second opening being smaller than the first opening and being contiguous with said first opening, said first opening allowing the paper to be more easily inserted through said drawer member and said exit port when said drawer member is in the open position.

16. The dispenser of claim 14 further comprising a front housing pivotally connected to said lower housing.

17. The dispenser of claim 16 further comprising a closing rib projecting from the inner surface of said upper housing, said closing rib urging said drawer member to said closed position when said front housing is pivoted toward said upper housing while said drawer member is in said open position.

18. A centerflow dispenser for dispensing a coreless rolled web comprising:

(a) a lower housing above which the rolled web is supported, said lower housing forming a first compartment;

(b) an upper housing mounted above said lower housing, said upper housing forming a second compartment, said second compartment for containing the rolled web, said first compartment having an opening into said second compartment;

(c) a disk rotatably residing within said lower housing, said disk rotatably said disk having a plurality of orifices of differing diameters disposed through the periphery thereof;

(d) an exit port through said lower housing, the rolled web being dispensed from the center of the roll, through said opening and through said exit port, each of said orifices are positioned to overlap said exit port by rotation of said disk so that the rolled web can be dispensed through a selected one of said orifices; and (e) a spring loaded drawer member within said lower housing.

19. The dispenser of claim 18, further wherein the upper housing comprises an inner surface and an outer surface, the inner surface of the housing engages and closes the drawer member to orient the dispenser for feeding paper through the exit port.

20. The dispenser of claim 19, further comprising a spring retention means which maintains the drawer member in a position such that it is biased towards an open position to facilitate the loading of the paper when the upper housing is in a first open position, and said drawer member is further closed against a spring resistance to facilitate feeding of paper through the exit port when the drawer member is in the closed position.

21. A method of dispensing a rolled web of paper from a coreless centerflow dispenser, comprising:

(a) providing a lower housing above which a rolled web is supported, said lower housing forming a first compartment, the lower housing comprising a spring loaded drawer member;

(b) providing an upper housing mounted above said lower housing, said upper housing forming a second compartment, said second compartment for containing the rolled web, said first compartment having an opening into said second compartment;

(c) providing a rotatable disk within said lower housing, said disk having a plurality of orifices of differing diameters disposed through the periphery of the disk;

(d) providing an exit port through said lower housing, the rolled web being dispensed from the center of the roll, through said orifice and through said exit port, each of said orifices capable of being positioned to overlap said exit port by rotation of said disk so that the rolled web is be dispensed through a selected one of said orifices;

(e) springing open a drawer member when the housing is opened, the drawer member being configured to open automatically when the housing is opened;

(f) loading a paper web into the housing of the dispenser;

(g) closing the housing of the dispenser; and (h) dispensing paper from the dispenser.

* * * * *